US010287880B2

(12) United States Patent
Indo et al.

(10) Patent No.: US 10,287,880 B2
(45) Date of Patent: May 14, 2019

(54) SYSTEMS AND METHODS FOR PUMP CONTROL BASED ON ESTIMATED SATURATION PRESSURE OF FLOW-LINE FLUID WITH ITS ASSOCIATED UNCERTAINTY DURING SAMPLING OPERATIONS AND APPLICATION THEREOF

(71) Applicant: Schlumberger Technology Corporation, Sugar Land, TX (US)

(72) Inventors: Kentaro Indo, Sugar Land, TX (US); Julian Pop, Houston, TX (US); Sepand Ossia, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 233 days.

(21) Appl. No.: 15/465,788

(22) Filed: Mar. 22, 2017

(65) Prior Publication Data

US 2017/0284199 A1 Oct. 5, 2017

Related U.S. Application Data

(60) Provisional application No. 62/315,801, filed on Mar. 31, 2016.

(51) Int. Cl.

| | |
|---|---|
| ***E21B 49/10*** | (2006.01) |
| *E21B 49/08* | (2006.01) |
| *E21B 47/18* | (2012.01) |

(52) U.S. Cl.
CPC ..... *E21B 49/10* (2013.01); *E21B 47/18* (2013.01); *E21B 2049/085* (2013.01)

(58) Field of Classification Search
CPC ..... E21B 49/10; E21B 47/18; E21B 2049/085
See application file for complete search history.

(56) References Cited

U.S. PATENT DOCUMENTS

| | | | | |
|---|---|---|---|---|
| 8,024,125 | B2 | 9/2011 | Hsu et al. | |
| 9,115,567 | B2 | 8/2015 | Hsu et al. | |
| 9,169,727 | B2 | 10/2015 | Hsu et al. | |
| 2011/0088895 | A1* | 4/2011 | Pop | E21B 7/04 166/254.2 |

* cited by examiner

*Primary Examiner* — Brad Harcourt

(57) ABSTRACT

A downhole fluid testing system includes a downhole acquisition tool housing configured to be moved into a wellbore, where the wellbore contains fluid that comprises a native reservoir fluid of a geological formation and a contaminant. The system includes a pump to pump fluid through the downhole acquisition tool, a sensor configured to analyze portions of the fluid and obtain a fluid property the fluid from an optical spectrometer, including an optical density, and a controller coupled to the housing to receive a first plurality of measurements over time from the sensor, estimate a future saturation pressure of the fluid at specific time increments via a processor based in part on the first plurality of measurements and a saturation pressure model, and control a flow rate of the pump that causes the flow line pressure to remain above the estimated future saturation pressure plus a value of the associated uncertainty.

20 Claims, 14 Drawing Sheets

SYSTEMS AND METHODS FOR PUMP CONTROL BASED ON ESTIMATED SATURATION PRESSURE OF FLOW-LINE FLUID WITH ITS ASSOCIATED UNCERTAINTY DURING SAMPLING OPERATIONS AND APPLICATION THEREOF

CROSS-REFERENCE TO RELATED APPLICATIONS

This application claims the benefit of U.S. Patent Application No. 62/315,801 filed on Mar. 31, 2016, which application is expressly incorporated herein by this reference in its entirety.

BACKGROUND

This disclosure relates to generally to oil and gas exploration systems and, more particularly, to systems and methods for estimating saturation pressure by sampling formation fluids.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light.

Wells are generally drilled into a surface (land-based) location or ocean bed to recover natural deposits of oil and natural gas, as well as other natural resources that are trapped in geological formations. A well may be drilled using a drill bit attached to the lower end of a "drill string," which includes a drill pipe, a bottom hole assembly, and other components that facilitate turning the drill bit to create a borehole. Drilling fluid, or "mud," is pumped down through the drill string to the drill bit during a drilling operation. The drilling fluid lubricates and cools the drill bit, and it carries drill cuttings back to the surface through an annulus between the drill string and the borehole wall.

For oil and gas exploration, it may be desirable to have information about the subsurface formations that are penetrated by a borehole. More specifically, this may include determining characteristics of fluids stored in the subsurface formations. As used herein, fluid is meant to describe any substance that flows. Fluids stored in the subsurface formations may include formation fluids, such as natural gas or oil. Thus, a fluid sample representative of the formation fluid maybe taken by a downhole tool and analyzed. As used herein, a representative fluid sample is intended to describe a sample that has relatively similar characteristics (e.g., composition and state) to the formation fluid to facilitate determining characteristics of the formation fluid.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In a first embodiment, a downhole fluid testing system includes a downhole acquisition tool housing configured to be moved into a wellbore, where the wellbore contains fluid that comprises a native reservoir fluid of a geological formation and a contaminant. The system includes a pump to pump fluid through the downhole acquisition tool, an optical spectrometer comprising at least one sensor. The optical spectrometer is configured to receive a first plurality of measurements output by the at least one sensor and to analyze portions of the fluid to obtain a fluid property of the fluid, including an optical density. The system includes a controller comprising memory circuitry and processing circuitry, where the controller is coupled to the housing to receive the first plurality of measurements over time from the at least one sensor, estimate a future saturation pressure of the fluid and a value of an associated uncertainty within the flow line at specific time increments via the processing circuitry based in part on the first plurality of measurements and a saturation pressure model, and control a flow rate of the pump that causes the flow line pressure to remain above the estimated future saturation pressure plus the value of the associated uncertainty.

In another embodiment, a downhole fluid testing system, includes a downhole acquisition tool housing configured to be moved into a wellbore in a geological formation, wherein the wellbore or the geological formation, or both, contain fluid that comprises a native reservoir fluid of the geological formation and a contaminant. The system includes a pump configured to pump fluid through the downhole acquisition tool, an optical spectrometer comprising at least one sensor disposed in the downhole acquisition tool housing. The optical spectrometer is configured to receive a first plurality of measurements output by the at least one sensor and to analyze portions of the fluid and obtain a fluid property of the fluid, where the fluid property includes an optical density. The system includes a controller communicatively coupled to a surface level of the housing and the controller is configured to receive the first plurality of measurements over time from the at least one sensor. The controller is configured to estimate a future saturation pressure of the fluid and a value of an associated uncertainty within the flow line at specific time increments via the processing circuitry based at least in part on the first plurality of measurements and a saturation pressure model, and to control a flow rate of the pump that causes the flow line pressure to remain above the estimated future saturation pressure plus the value of the associated uncertainty.

In a further embodiment, a method includes pumping fluid from outside of a downhole tool through a flow line of the downhole tool with a pump, taking a first plurality of measurements over time using at least one sensor and estimating a future saturation pressure of the fluid within the flow line and a value of its uncertainty at defined time increments via a downhole controller based at least in part on the first plurality of measurements and a first saturation pressure model. The method includes adjusting the flow line pressure to maintain the pressure of the flow line above the estimated future saturation pressure, and using a surface controller at the surface to estimate the future saturation pressure when the flow line pressure goes below a saturation pressure of the flow line, based at least upon the first plurality of measurements and a second saturation pressure model.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
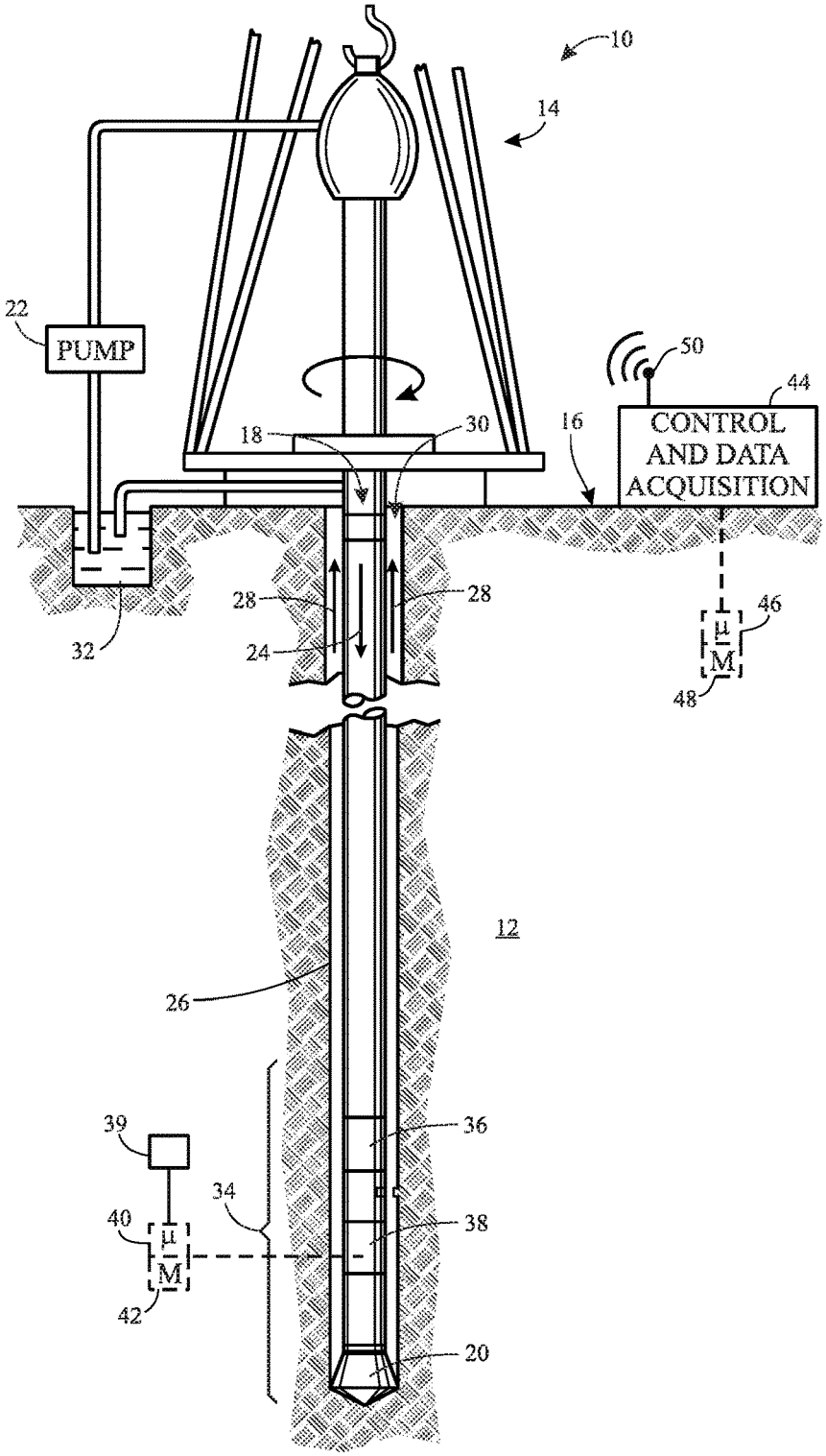
FIG. 1 is a schematic diagram of a drilling system including a downhole tool used to sample formation fluid, in accordance with an embodiment of the present techniques.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions can be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of this disclosure relate to operating a pump in a downhole tool to capture a fluid sample representative of a formation fluid. This disclosure generally relates to operating a pump in a downhole tool to capture a fluid sample representative of a formation fluid. During oil or natural gas exploration, it may be desirable to measure and/or evaluate the properties of the formations surrounding a borehole. For example, this may include capturing and evaluating a sample of fluid trapped in the formations, which may be referred to as formation fluid. When capturing such a sample, it is desirable that the sample be representative of the formation fluid. More specifically, the sample may have a similar composition and state as the formation fluid. However, in many drilling operations, drilling fluid (e.g., drilling mud) is often pumped into the borehole to facilitate drilling. As the drilling mud is cycled through the drilling process, the filtrate of drilling fluid may seep into the formations and mix with (e.g., contaminate) the formation fluid close to the borehole. In addition, in many fluid sampling operations, a pump is used to pump surrounding fluid into a downhole tool. More specifically, the pump may reduce the pressure in the downhole tool below the pressure in the formation (e.g., formation pressure). Depending on the composition of fluid pumped into the downhole tool, the reduction in pressure may cause a state change (e.g., release of gas, liquid, asphaltene, or the like) if the pressure is reduced below a saturation pressure (e.g., dew point pressure, bubble point pressure, asphaltene onset pressure, or the like). As used herein, the saturation pressure refers to a threshold pressure under an isothermal condition that may cause a state change such as a dew point pressure for a gas (e.g., natural gas), a bubble point pressure for a liquid (e.g., oil), an asphaltene onset pressure for a liquid (e.g., oil), or the like.

Traditional techniques may capture a contaminated fluid sample (e.g., containing an appreciable amount of drilling fluid filtrate) in a controlled volume and decrease the pressure in the controlled volume to determine the saturation pressure of the contaminated fluid sample. The determined saturation pressure may then be used in a pump equation to determine a pumping rate designed to avoid dropping the pressure in the downhole tool below the saturation pressure. However, these features may be inefficient. For example, because space in a downhole tool is limited, the additional controlled volume capable of decreasing pressure utilized by these techniques may occupy space in the tool that could be used for other purposes. Furthermore, because the properties (e.g., contamination level) of the fluid pumped into a downhole tool may change, a pumping rate determined at one time during pumping may be inaccurate if used at a later time when the contamination level may have changed. For example, when the contamination level and the saturation pressure are high, the pump may be controlled to pump faster than the determined pumping rate obtained from some other contamination level while maintaining the pressure in the downhole tool greater than the saturation pressure. Thus, it may be desirable to provide techniques for operating a pump in a downhole tool to facilitate efficient sampling of the formation fluid when the contamination level and saturation pressure of fluid in the flow line changes during pumping.

Accordingly, the present disclosure includes a system and method for operating a pump in a downhole tool to capture a fluid sample representative of the formation fluid. More specifically, the present techniques may include: pumping fluid from outside of the downhole tool through a flow line of the downhole tool, taking a measurements within the flow line while pumping the fluid using at least one sensor, estimating a saturation pressure of the fluid with the processor based at least in part on the measurements taken in the flow line and a saturation pressure model, and adjusting an operating parameter of a pump with a controller to maintain pressure in the flow line greater than the estimated saturation pressure. In other words, the saturation pressure of the fluid may be estimated directly from measurements, such as optical density, taken while the fluid is being pumped through the flow line of the downhole tool. For example, in some embodiments, an optical spectrometer may be used to measure the optical density of the fluid in the flow line across several wavelengths. The optical density measurements may be used to obtain compositional information to be employed to model the saturation pressure. In certain embodiments, the optical density measurements may be directly input into the saturation pressure model to provide estimates of saturation pressure. The estimated saturation pressures may then be employed to control the pump to maximize the pumping rate while maintaining the pressure in the flow line greater than the estimated saturation pressure. In certain embodiments, the estimated saturation pressure can be adjusted by a corrective parameter to estimate a future saturation pressure if the flow line pressure goes below the bubble point of the fluid.

By way of introduction, FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a drilling fluid pump 22 is used to pump drilling fluid, commonly referred to as "mud" or "drilling mud," downward through the center of the drill string 18 in the direction of the arrow 24 to the drill bit 20. The drilling fluid, which is used to cool and lubricate the drill bit 20, exits the drill string 18 through ports (not shown) in the drill bit 20. The drilling fluid then carries drill cuttings away from the bottom of a borehole 26 as it flows back to the surface 16, as shown by the arrows 28 through an annulus 30 between the drill string 18 and the formation 12. However, as described above, as the drilling fluid flows through the annulus 30 between the drill string 18 and the formation 12, the drilling mud may begin to invade and mix with the fluids stored in the formation, which may be referred to as formation fluid (e.g., natural gas or oil). At the surface 16, the return drilling fluid is filtered and conveyed back to a mud pit 32 for reuse.

Furthermore, as illustrated in FIG. 1, the lower end of the drill string 18 includes a bottom-hole assembly 34 that may include the drill bit 20 along with various downhole tools (e.g., modules). For example, as depicted, the bottom-hole assembly 34 includes a measuring-while-drilling (MWD) tool 36 and a logging-while-drilling (LWD) tool 38. The various downhole tools (e.g., MWD tool 36 and LWD tool 38) may include various logging tools, measurement tools, sensors, devices, formation evaluation tools, fluid analysis tools, fluid sample devices, and the like to facilitate determining characteristics of the surrounding formation 12 such as the properties of the formation fluid. For example, the LWD tool 38 may include a fluid analysis tool (e.g., an optical spectrometer 39) to measure light transmission of the fluid in the flow line, a processor 40 to process the measurements, and memory 42 to store the measurements and/or computer instructions for processing the measurements.

As used herein, a "processor" or processing circuitry refers to any number of processor components related to the downhole tool (e.g., LWD tool 38). For example, in some embodiments, the processor 40 may include one or more processors disposed within the LWD tool 38. In other embodiments, the processor 40 may include one or more processors disposed within the downhole tool (e.g., LWD tool 38 ) communicatively coupled with one or more processors in surface equipment (e.g., control and data acquisition unit 44 ). Thus, any desirable combination of processors may be considered part of the processor 40 in the following discussion. Similar terminology is applied with respect to the other processors described herein, such as other downhole processors or processors disposed in other surface equipment.

In addition, the LWD tool 38 may be communicatively coupled to a control and data acquisition unit 44 or other similar surface equipment. More specifically, via mud pulse telemetry system (not shown), the LWD tool 38 may transmit measurements taken or characteristics determined to the control and data acquisition unit 44 for further processing. Additionally, in some embodiments, this may include wireless communication between the LWD tool 38 and the control and data acquisition unit 44. Accordingly, the control and data acquisition unit 44 may include a processor 46, memory 48, and a wireless unit 50.

Figure 2:
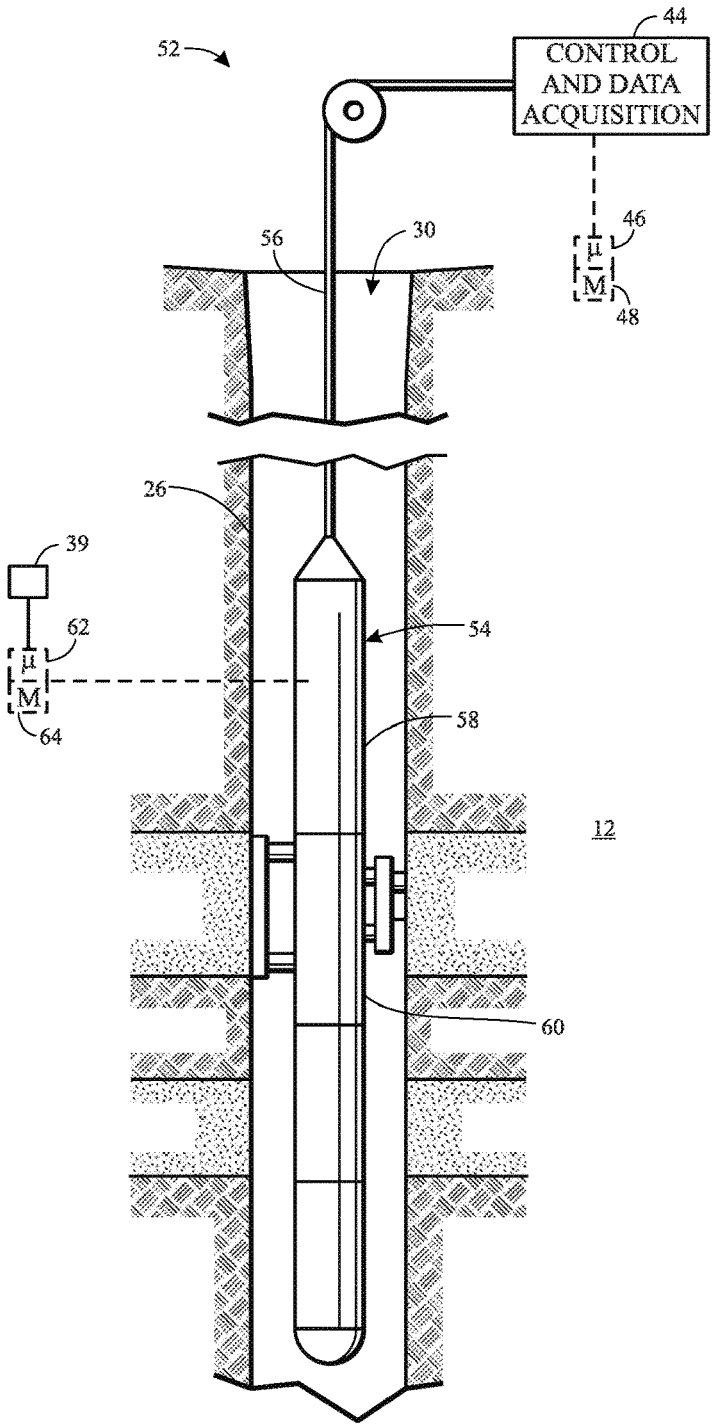
FIG. 2 is a schematic diagram of a wireline system including a downhole tool used to sample formation fluid, in accordance with an embodiment of the present techniques.

In addition to being included in the drilling system 10, various downhole tools (e.g., wireline tools) may also be included in a wireline system 52, as depicted in FIG. 2. As depicted, the wireline system 52 includes a wireline assembly 54 suspended in the borehole 26 and coupled to the control and data acquisition unit 44 via a cable 56. Similar to the bottom-hole assembly 34, various downhole tools (e.g., wireline tools) may be included in the wireline assembly 54. For example, as depicted, the wireline assembly 54 includes a telemetry tool 58 and a formation testing tool 60. In some embodiments, the formation testing tool 60 may take measurements and communicate the measurements to the telemetry tool 58 to determine characteristics of the formation 12. For example, similar to the LWD tool 38, the formation testing tool 60 may include a fluid analysis tool (e.g., an optical spectrometer 39) to measure light transmission of fluid in the flow line, and the telemetry tool 58 may include a processor 62 to process the measurements and memory 64 to store the measurements and/or computer instructions for processing the measurements. Thus, in some embodiments, the telemetry tool 58 may be included in the formation testing tool 60. The formation testing tool 60 may be communicatively coupled to the control and data acquisition unit 44 and transmit measurements taken or characteristics determined to the control and data acquisition unit 44 for further processing.

In other embodiments, features illustrated in FIGS. 1 and 2 may be employed in a different manner. For example, various downhole tools may also be conveyed into a borehole via other conveyance methods, such as coil tubing or wired drill pipe. For example, a coil tubing system may be similar to the wireline system 52 with the cable 56 replaced with a coiled tube as a method of conveyance, which may facilitate pushing the downhole tool further down the borehole 26.

Figure 3:
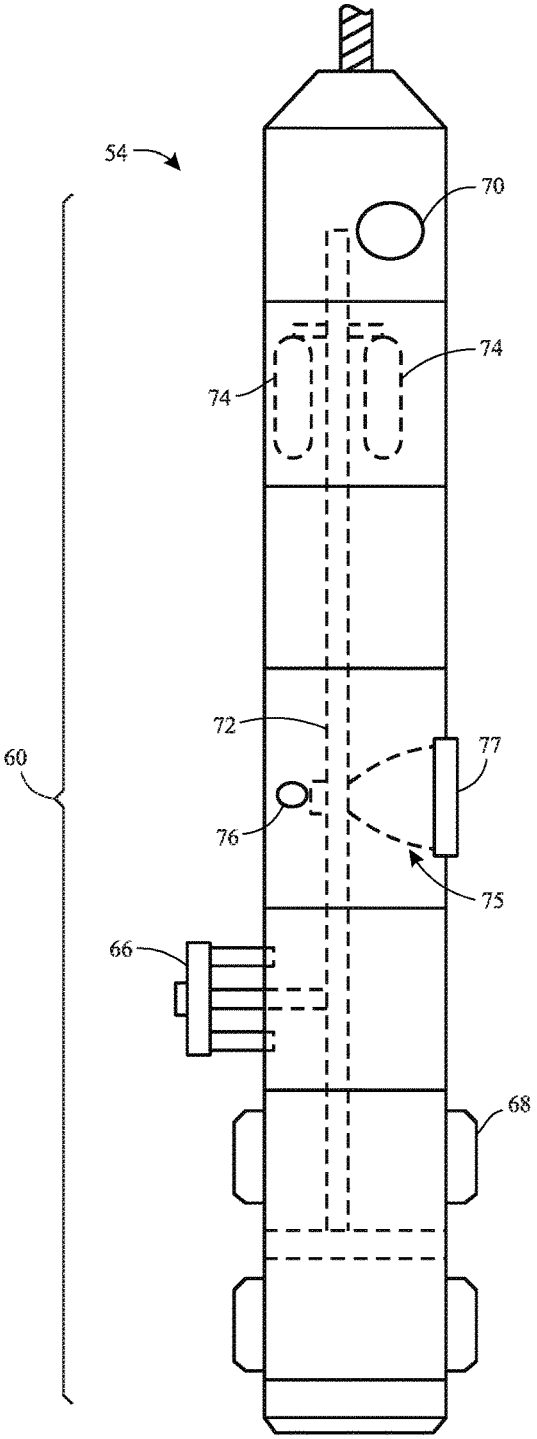
FIG. 3 is a schematic diagram of the downhole tool of FIG. 2 used to determine formation fluid properties, in accordance with an embodiment of the present techniques.

As described above, to facilitate determining characteristics of the formations 12 surrounding the borehole 26, samples of fluid representative of the formation fluid may be taken. More specifically, the samples may be gathered by various downhole tools such as the LWD tool 38, a wireline tool (e.g., formation sampling tool 60), a coil tubing tool, or the like. To help illustrate, a schematic of the wireline assembly 54, including the formation sampling tool 60, is depicted in FIG. 3. It should be appreciated that the techniques described herein may also be applied to LWD tools and coil tubing tools.

To begin sampling the fluids in the formation 12 surrounding the formation sampling tool 60, the formation sampling tool 60 may engage the formation in various manners. For example, in some embodiments, the formation sampling tool 60 may extend a probe 66 to contact the formation 12, and formation fluid may be withdrawn into the sampling tool 60 through the probe 66. In other embodiments, the formation sampling tool 60 may inflate packers 68 to isolate a section of the formation 12 and withdraw fluid into the formation 12 through an opening in the sampling tool between the packers. In a further embodiment, a single packer may be inflated to contact the formation 12, and fluid from the formation may be drawn into the sampling tool 60 through an inlet (e.g., a drain) in the single packer.

Once the formation sampling tool 60 has engaged the formation 12, a pump 70 may extract fluid from the formation by decreasing the pressure in a flow line 72 of the formation sampling tool 60. As described above, when the pump 70 initially begins to extract fluid from the surrounding formation 12, the extracted fluid may be contaminated (e.g., contain an appreciable amount of drilling fluid filtrate) and be unrepresentative of the formation fluid. Accordingly, the pump 70 may continue to extract fluid from the formation 12 until it is determined that a representative fluid sample (e.g., single-phase with minimal contamination) may be captured. Various methods are known to determine the contamination level of the fluid in the flow line 72. One such method is based on analyzing optical spectrometer data, and is described in more detail in U.S. Pat. No. 8,024,125 entitled "Methods and Apparatus to Monitor Contamination Levels in a Formation Fluid," which is incorporated herein by reference. For example, in certain embodiments, the contamination level may be monitored using a trend model that compares optical densities of the formation fluid at different wavelengths. During the initial pumping process, the pump 70 may expel the extracted fluid back into the annulus 30 at a different location (not shown) from the sample point (e.g., the location of the probe 66). A representative fluid sample may be captured in sample bottles 74 in the formation sampling tool 60 when a minimum contamination level is achieved.

As depicted in FIG. 3, the formation sampling tool 60 also includes a fluid analysis tool 75. The fluid analysis tool 75 may take various measurements on fluid flowing through the flow line 72, such as optical density or ultrasonic transmission. For example, the fluid analysis tool 75 may be an optical spectrometer 39 that takes optical density measurements by measuring light transmission of fluid as it is pumped through the flow line 72. In some embodiments, the optical spectrometer 39 may take a plurality of measurements by measuring light transmission across multiple wavelengths. Accordingly, the fluid analysis tool 75 (e.g., optical spectrometer 39) may include a light emitter or source 76 and a light detector or sensor 77 disposed on opposite sides of the flow line 72. More specifically, the fluid analysis tool 75 may determine the proportion of light transmitted through the fluid and detected by the light sensor 77.

Furthermore, as described above, the decrease of pressure in the flow line 72 while extracting fluid from the formation 12 and pumping the fluid through the flow line may cause the fluid to drop below its saturation pressure (e.g., dew point, bubble point, or asphaltene onset). For example, when the pressure in the flow line 72 is dropped below a dew point pressure of a gas (e.g., natural gas), liquid droplets may begin to form. Similarly, when the pressure in the flow line 72 is dropped below a bubble point of a liquid (e.g., oil), gas may be released. As will be described in more detail below, such phase changes and their onset may be detected and determined by the fluid analysis tool 75. For example, as bubbles begin to form in a liquid (e.g., oil), the fluid analysis tool 75 (e.g., optical spectrometer 39) may determine the bubble point of the liquid because the bubbles scatter light and cause light transmission to sharply decrease.

Figure 4:
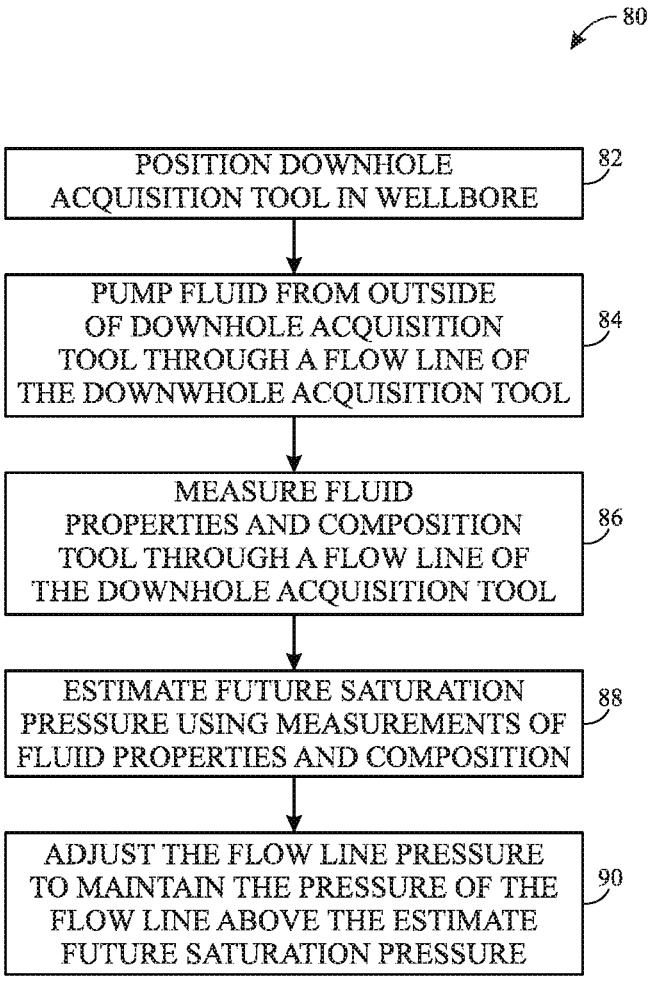
FIG. 4 is a process flow diagram of a method for controlling a pump in a downhole tool, in accordance with an embodiment of the present techniques.

To facilitate obtaining a representative sample (e.g., single phase and low contamination) of the formation fluid, it is desirable to control the pump 70 to maintain the pressure in the flow line 72 greater than the saturation pressure of fluid in the flow line 72 when the sample is taken. Accordingly, a process 80 for controlling the pump 70 during a sampling process is depicted in FIG. 4.

As will be described in more detail below, the process 80 includes positioning a downhole acquisition tool in a wellbore (process block 82). The formation fluid is pumped from outside of the downhole acquisition tool through a flow line of the downhole acquisition tool (process block 84) so that the formation fluid properties can be examined. Measurements of the fluid in the flow line can be taken (process block 86) to determine certain properties of the fluid and the composition of the fluid in the flow line. Using a saturation pressure model and the properties of the fluid measured, an estimated future saturation pressure can be calculated (process block 88). The pressure of the flow line may be adjusted to maintain the pressure of the flow line above the estimated future saturation pressure (process block 90).

Figure 5:
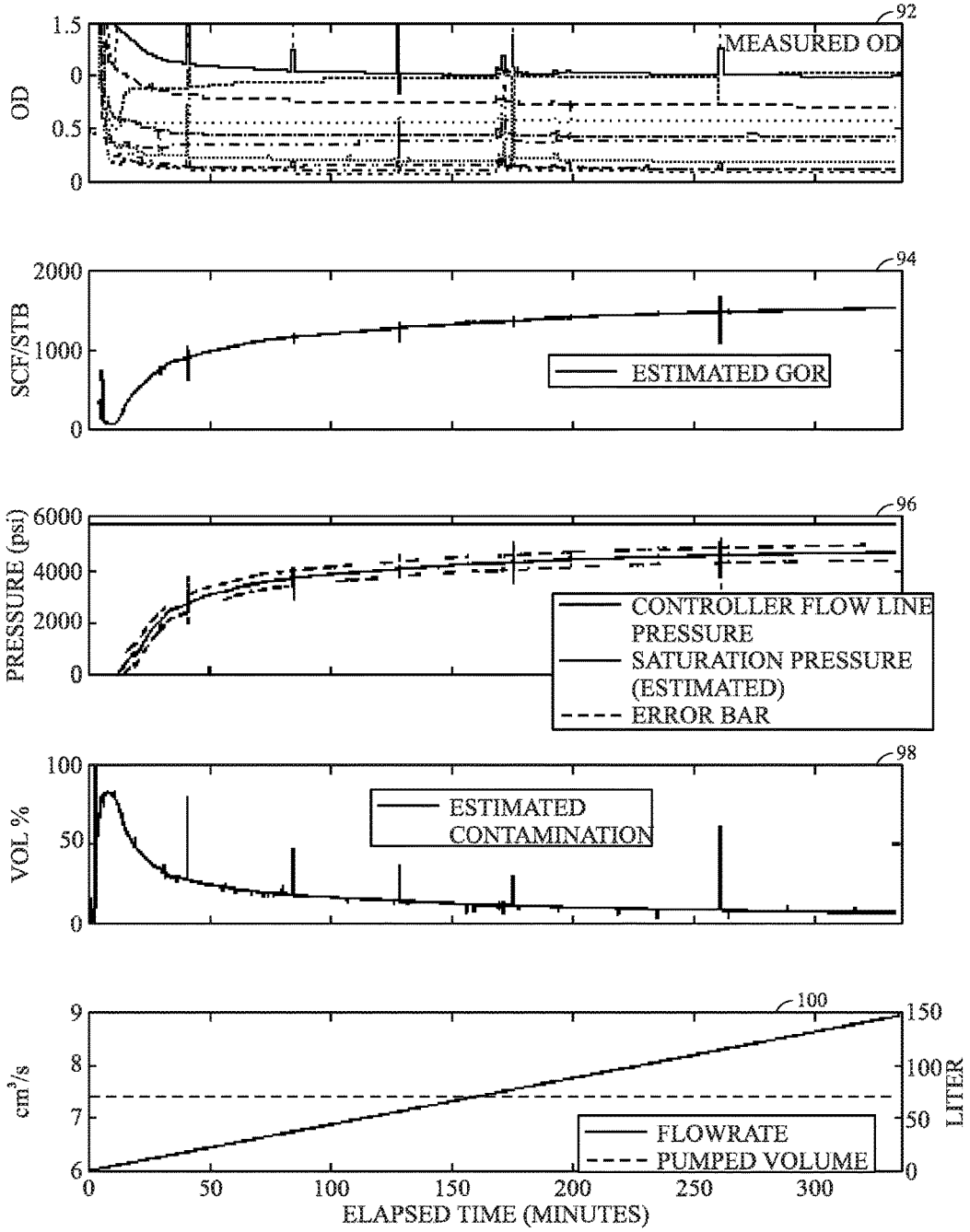
FIG. 5 is a plot illustrative of several characteristics of a sample fluid while a sampling-while-drilling operation is performed while a constant flow line pressure is maintained.
Figure 6:
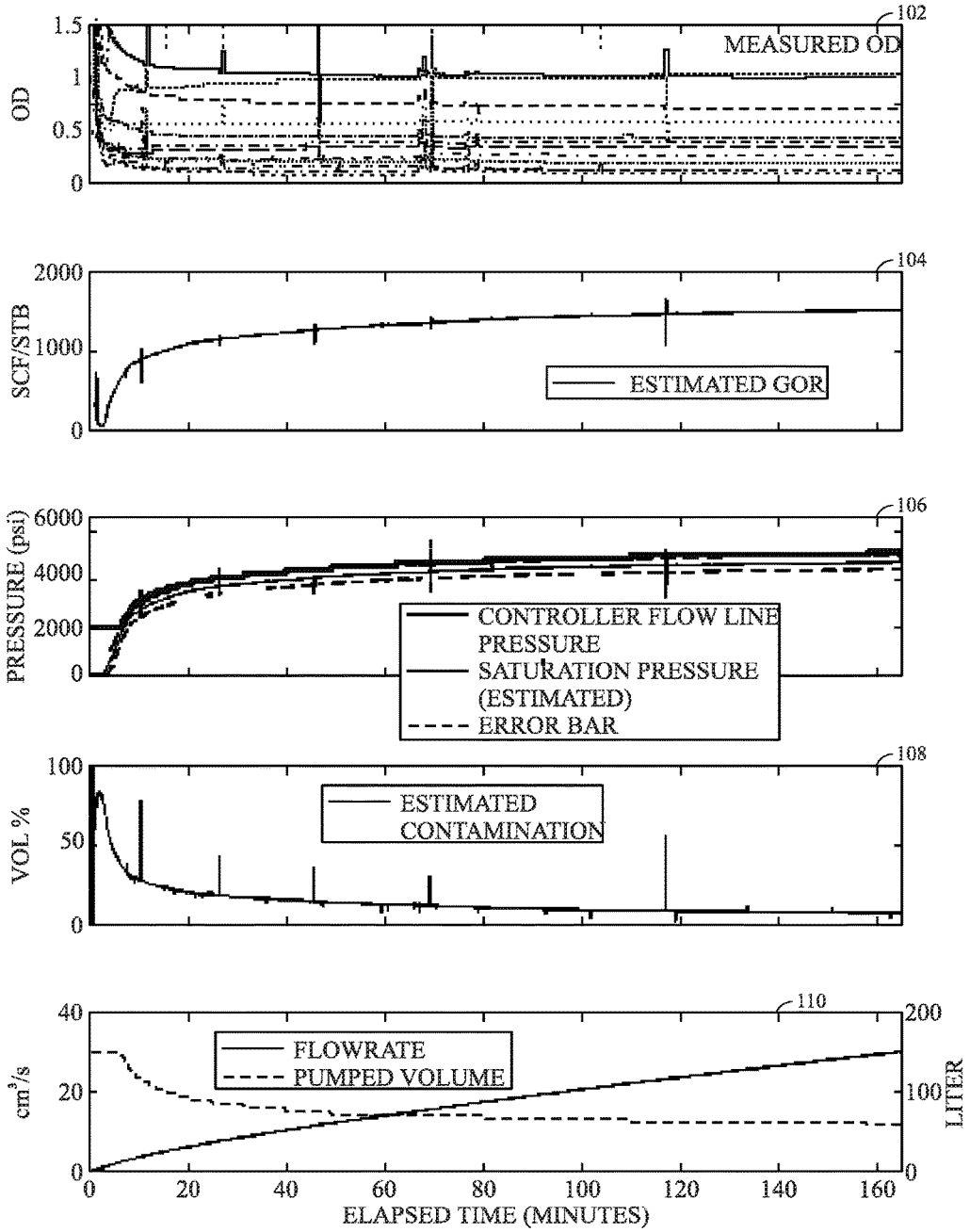
FIG. 6 is a plot illustrative of several characteristics of a sample fluid while a sampling-while-drilling operation is performed while the flow line pressure is controlled, in accordance with an embodiment of the present techniques.

An example of the improved contamination level by using the saturation pressure model is illustrated in FIGS. 5-6 by way of comparison. Specifically, FIG. 5 illustrates a sampling-while-drilling operation while a constant flow line pressure is maintained. The topmost plot illustrates measured optical density over numerous channels on the Y-axis versus time on the X-axis in minutes (block 92). The second plot illustrates an estimated gas to oil ratio, with gas to oil ratio measured in standard cubic feet per stock tank barrel on the Y-axis versus time on the X-axis (block 94). The third plot illustrates an estimated saturation pressure while the flow line pressure is controlled, where pressure in psi is on the Y-axis versus time on the X-axis (block 96). For example, the flow line pressure is controlled at or approximately 5,750 psi in the example. The fourth plot illustrates an estimated contamination level (block 98) in volume percent on the Y-axis and time on the X-axis. The fifth plot illustrates a flowrate and accumulated pumped volume versus simulated pumping time on the X-axis (block 100). FIG. 6 illustrates a sampling-while-drilling operation while the flow line pressure is controlled based on a future estimated saturation pressure plus the associated uncertainty. Here again, the topmost plot illustrates measured optical density over numerous channels on the Y-axis versus time on the X-axis in minutes (block 102). The second plot illustrates an estimated gas to oil ratio with gas to oil ratio measured in standard cubic feet per stock tank barrel on the Y-axis versus time on the X-axis (block 104). The third plot illustrates an estimated saturation pressure while the flow line pressure is controlled to be above the future estimated saturation pressure plus the uncertainty of the future estimated saturation pressure, using the techniques described herein (block 106). The flow line pressure is measured in psi is on the Y-axis versus time on the X-axis. The fourth figure illustrates an estimated contamination level in volume percent on the Y-axis and time on the X-axis (block 108). The fifth plot illustrates a flowrate and accumulated pumped volume as a function of simulated pumping time (block 110).

As will be appreciated, a higher flowrate may be reached in the early pumping stages when the flow line pressure is controlled to be above the future estimated saturation pressure and its uncertainty (see FIG. 6) when compared to maintaining a substantially constant flow line pressure (see FIG. 5). As such, the contamination level can be reduced faster when the flow line pressure is maintained to be above the future estimated saturation pressure plus the uncertainty by using the saturation pressure model described herein. Accordingly, the pump operating time is reduced when the saturation pressure model is used to maintain the flow line pressure above the future estimated saturation pressure plus the uncertainty. Put another way, a greater reduction in contamination level can be achieved during a definitive operation time (e.g., during the same amount of operating time). The reduction in time to achieve a desired contamination level is further illustrated in FIG. 7.

Figure 7:
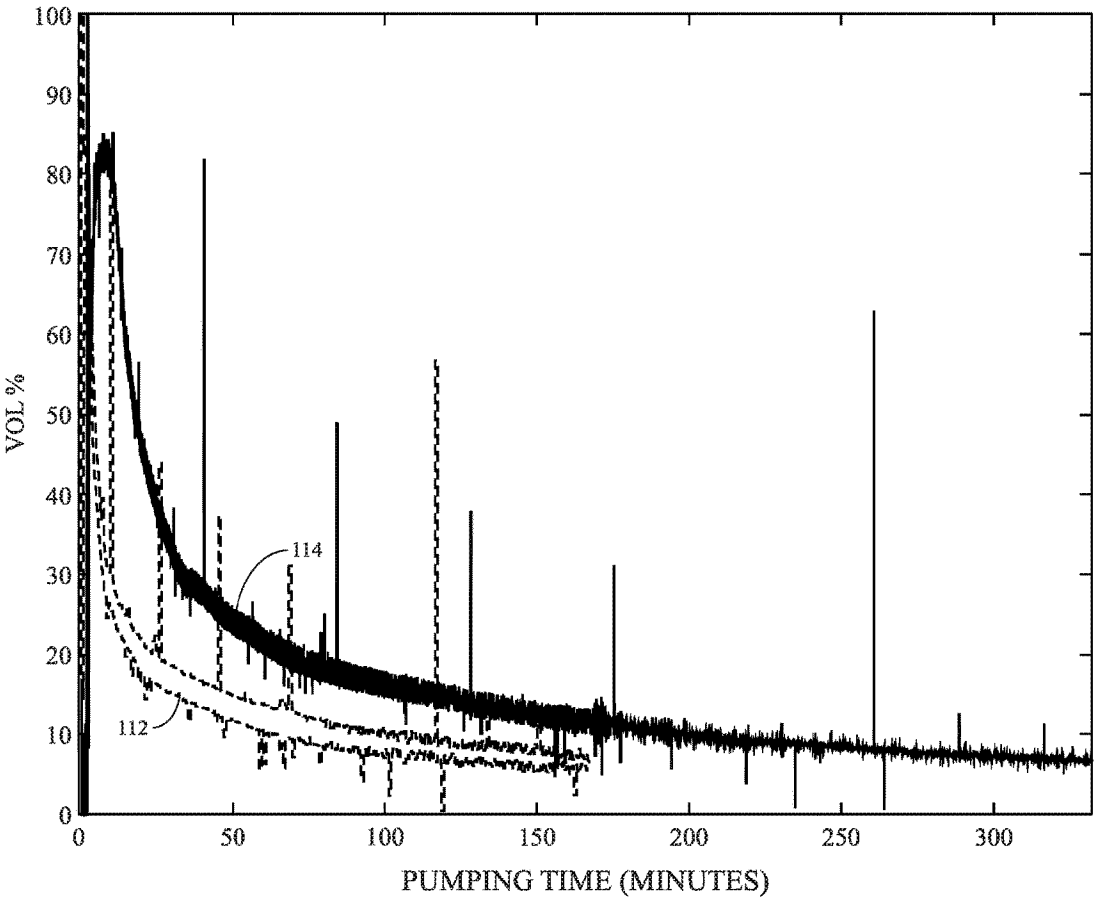
FIG. 7 is a plot representative of contamination level as a function of pumping time with constant flow line pressure versus controlled flow line pressure, in accordance with an embodiment of the present techniques.

FIG. 7 is a plot representative of contamination level as a function of pumping time with constant flow line pressure versus controlled flow line pressure. The contamination level is shown on the Y-axis, and the pumping time is shown on the X-axis. As illustrated, the contamination level when the flow line pressure is controlled using the saturation pressure model, the fluid reaches a lower contamination level in a shorter station time (e.g., line 112). For example, a desired reduction in contamination level can be achieved in approximately 160 minutes when the flow line pressure is controlled using the saturation pressure model (e.g., line 112). With constant flow line pressure (e.g., without use of the saturation pressure model, line 114), the same desired reduction in contamination level is achieved in over 300 minutes.

Estimated Future Saturation Pressure Model

As described above, controlling the flow line pressure by using the saturation pressure model (e.g., the estimated future saturation pressure model) as described herein can reduce the contamination level faster than when the flow line pressure is maintained at or around substantially constant pressure. Controlling the flow line pressure through the saturation pressure model includes maintaining the flow line pressure to be above the future estimated saturation pressure plus the uncertainty. Using the saturation pressure model results in reduced pump operating time to achieve a desired reduction (e.g., target) contamination level.

As described in detail below, the saturation pressure model uses optical spectrometer data acquired during sampling operations. The saturation pressure model may utilize a variety of different computational methodologies, including but not limited to, multivariate analysis, artificial neural networks, Bayesian networks, support vector machines, and so forth.

In a first example, the saturation pressure model may be estimated by multivariate analyses. By way of example, a linear regression model including second order terms as described below can be used for estimated the saturation pressure of the flow line fluid:

$$f(T, \{x_i\}) = a_T T + b_T T^2 + \sum_i a_i x_i + \sum \sum_{i \le j} b_{ij} x_i x_j \tag{1}$$

$$i, j \in CO_2, C_1, C_2, C_3, C_4, C_5, C_{6+}$$

where, $f$ is the estimated saturation pressure from temperature, T, and compositional inputs, $\{x_i\}$. Coefficients, $a_i$ and $b_{ij}$, are calibrated against a fluid library. Uncertainty of the estimate derived from the variability of the coefficients is also obtained as the variance of estimate as set forth below:

$$\Delta f_{model}^2 = \mathrm{var}(f_{input}) = X \,\mathrm{cov}(W) X^T \tag{2}$$

where, $X=[T, T^2, x_i, x_i x_j]$, $W=[a_T, b_T, a_i, b_{ij}]$, $i,j \in CO_2, C_1, C_2, C_3, C_4, C_5, C_{6+}$ An expected value of W can be obtained using a resampling technique, such as through using subsets of available data or drawing randomly with replacement from a set of data points (e.g., bootstrapping). The expected value of the coefficients is utilized in eq. (1) and therefore, the estimate from eq. (1) is the expected value of the saturation pressure. The uncertainty associated with the temperature and the estimate of the composition obtained by means of optical spectrometry can be determined using the following equation:

$$\Delta f_{input}^2 = \mathrm{var}(f_{input}) = \sum_k \sum_l \frac{\partial f}{\partial X_k} \frac{\partial f}{\partial X_l} \Delta X_k \Delta X_l \tag{3}$$

where, $\Delta X_k$ denotes uncertainty of the inputs. Consequently, the uncertainty of the estimate combined eq. (2) and (3) is represented as follows:

$$\Delta f^2 = \Delta f_{model}^2 + \Delta_{input}^2 \tag{4}$$

In a second example, the saturation pressure may be estimated by using an artificial neural network (ANN) based model. In this example, the ANN is based on eight input variable including Temperature (T), weight fraction of $CO_2$, $C_1$, $C_2$, $C_3$, $C_4$, $C_5$, and $C_6$. In this example, the eight input variables were validated against the saturation pressures of a portion (e.g., 70%) of randomly selected samples in a fluid library and validated against the remaining (e.g., 30%) of the samples in the fluid library. The input variables were connected to a hidden layer (e.g., system layers) by nine nodes with weights and biases. In the hidden layer, sigmoidal functions were employed as the activation function. This ANN is represented using an equation as set forth below:

$$f(X) = \sum_j w_j^{(1)} g_j\left(\sum_i w_{ij}^{(0)} x_i\right)(i \le 8,\ j \le 9), \tag{5}$$

$$\text{where } g(t) = \frac{2}{1+e^{-t}}$$

Figure 8:
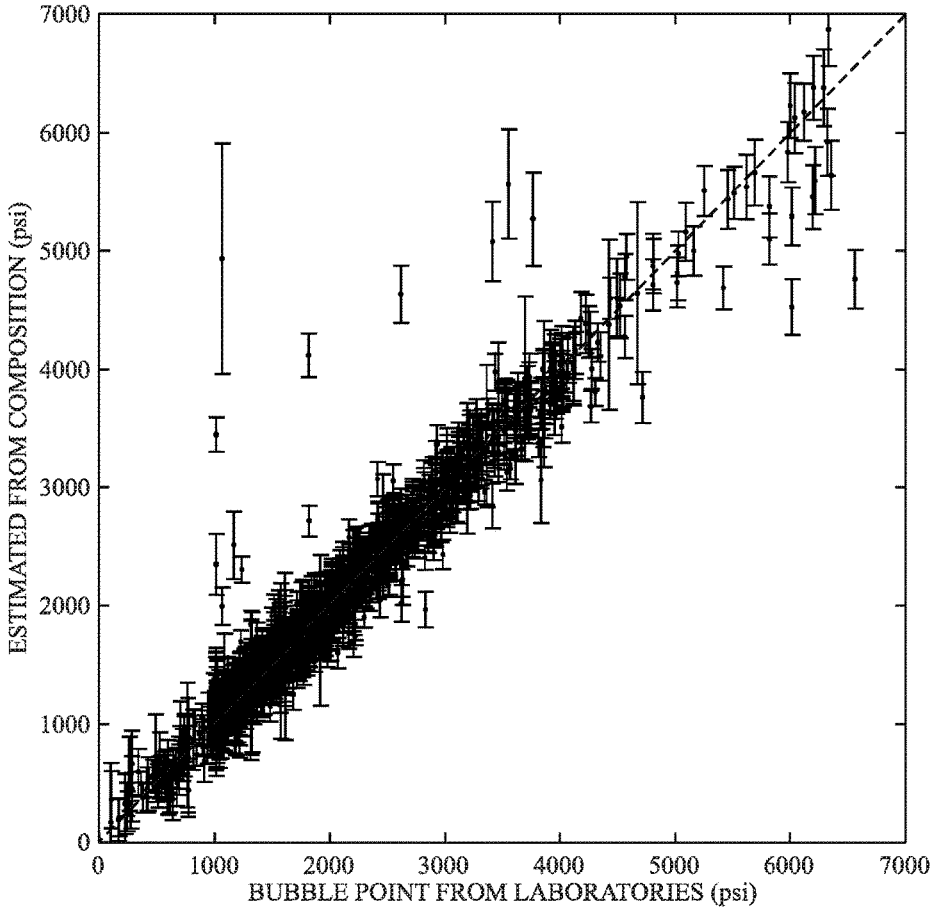
FIG. 8 is a plot representative of measured saturation pressure versus estimated saturation pressure determined from a saturation pressure model, in accordance with an embodiment of the pressure techniques.

Note that the biases (b) in the hidden and the output layers are, respectively, absorbed into the weights, $w^{(0)}$ and $w^{(1)}$. Using the ANN saturation pressure model described above, the estimation results calculated from the ANN saturation pressure model can be compared. Turning now to FIG. 8, the bubble point estimation of a fluid as estimated from the ANN saturation pressure model is plotted on the Y-axis in psi against the bubble points calculated from laboratory analysis in psi on the X-axis. Using the ANN saturation pressure model, a standard deviation of approximately 170 psi between the estimated bubble point and the laboratory analyzed can be observed.

The uncertainty is derived based on variability of weights in the neural networks. However, variability of weights in the hidden layer is not considered, and the variability is assumed to be absorbed into the variability of weights in the output layer. Consequently, the uncertainty of the prediction originated from the neural network model is approximately given:

$$\Delta f^2 \approx g\ \mathrm{cov}(w^{(1)}) g^T \tag{6}$$

In a similar manner on the multivariate model (e.g., first example) described above, uncertainty originated from estimated composition is also obtained. To adjust for uncertainty, a parameter, a, is introduced and applied to weight fraction of $C_{6+}$ ($x_{C6+}$) which is one of the inputs to the model, as set forth below:

$$x_{C6+} \rightarrow (1+\alpha) x_{C6+} \tag{7}$$

This adjustment implies to tune molecular weight of $C_{6+}$ component ($MW_{C6-}$). As the summation of the components in weight fraction should be equal to one, inputs of weight fraction should be normalized by the summation after the tuning parameter is applied, thus:

$$x_i \rightarrow \frac{x_i}{\sum_i x_i + (1+\alpha)x_{C6+}}, \tag{8}$$

$$x_{C6+} \rightarrow \frac{(1+\alpha)x_{C6+}}{\sum_i x_i + (1+\alpha)x_{C6+}},$$

$$i \in CO_2, C_1, C_2, C_3, C_4, C_5$$

When bubbles start emerged and light scattering is observed at time, t, the saturation pressure of the flow line fluid, $P_{sat}(t)$, should be nearly equal to the flow line pressure, $P_{FL}(t)$.

$$P_{sat}(t) \approx P_{FL}(t) \tag{9}$$

The parameter, α, is to be adjusted to be satisfied:

$$\alpha' = \arg\min_\alpha \{P_{FL}(t) - \tilde{P}_{sat}(t, X(\alpha))\} (0<\alpha<1) \tag{10}$$

Where α' is the adjusted parameter, $\tilde{P}_{sat}$ is the estimated saturation pressure at time, t, and X (α) is the input to the model with the adjustment parameter, α, as set forth below:

$$X(\alpha) = [T, x_i', x_{C6+}'] (i \in CO_2, C_1, C_2, C_3, C_4, C_5] \tag{11}$$

$$x_i' = \frac{x_i}{\sum_i x_i + (1+\alpha)x_{C6+}}, \tag{12}$$

$$x_{C6+}' \rightarrow \frac{(1+\alpha)x_{C6+}}{\sum_i x_i + (1+\alpha)x_{C6+}}$$

Figure 9:
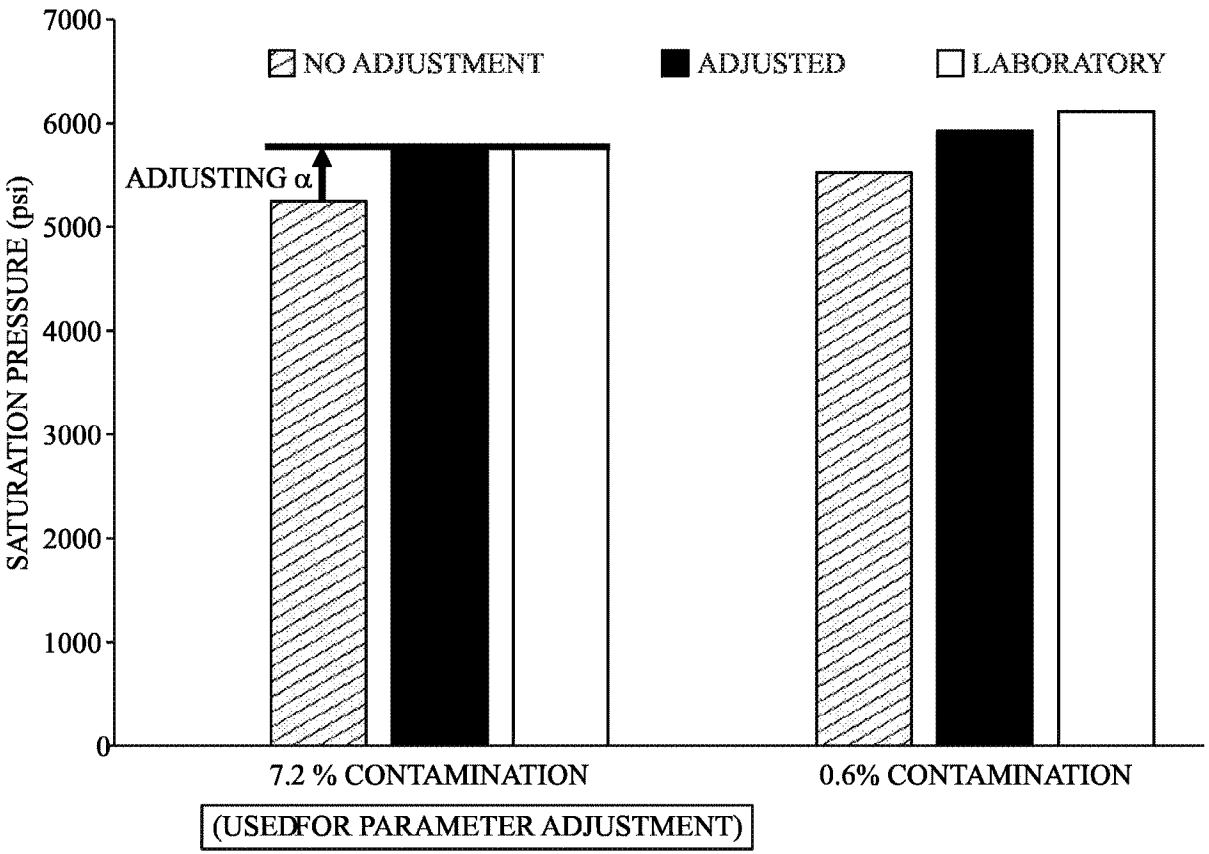
FIG. 9 is a graphical representation of measured saturation pressure versus estimated saturation pressure determined from the saturation pressure model, in accordance with an embodiment of the pressure techniques.

An example of estimating the saturation pressure using the saturation pressure model with and without the adjustment parameter, α, is set forth below in FIG. 9. FIG. 9 is a graphical representation of measured saturation pressure versus estimated saturation pressure determined from a saturation pressure model, with and without tuning the model. The adjustment parameter was developed to enable the estimated saturation pressure to approach (e.g., get close) to the laboratory measured saturation pressure. In one example, the parameter, a, was adjusted based on the saturation pressure at 7.2% contaminated crude oil. Here, the estimated saturation pressure before the adjustment is ~5246 psi in comparison with 5750 psi measured by a PVT laboratory.

Using the adjusted parameter, the saturation pressure of same crude oil (but at a different contamination level) was estimated. Before the adjustment the estimated saturation pressure is ~5520 psi in comparison with ~6110 psi laboratory measure saturation pressure. After the adjustment, the saturation pressure of 0.6% contaminated crude oil is estimated to be 5924 psi with the adjusted parameter, which is obtained from the 7.2% contaminated crude oil. Accordingly, adjusting the estimated saturation pressure with the adjustment parameter, α, results in an improved (e.g., more accurate) estimate of saturation pressure of the sample.

Flow Line Pressure Control Model

Figure 10:
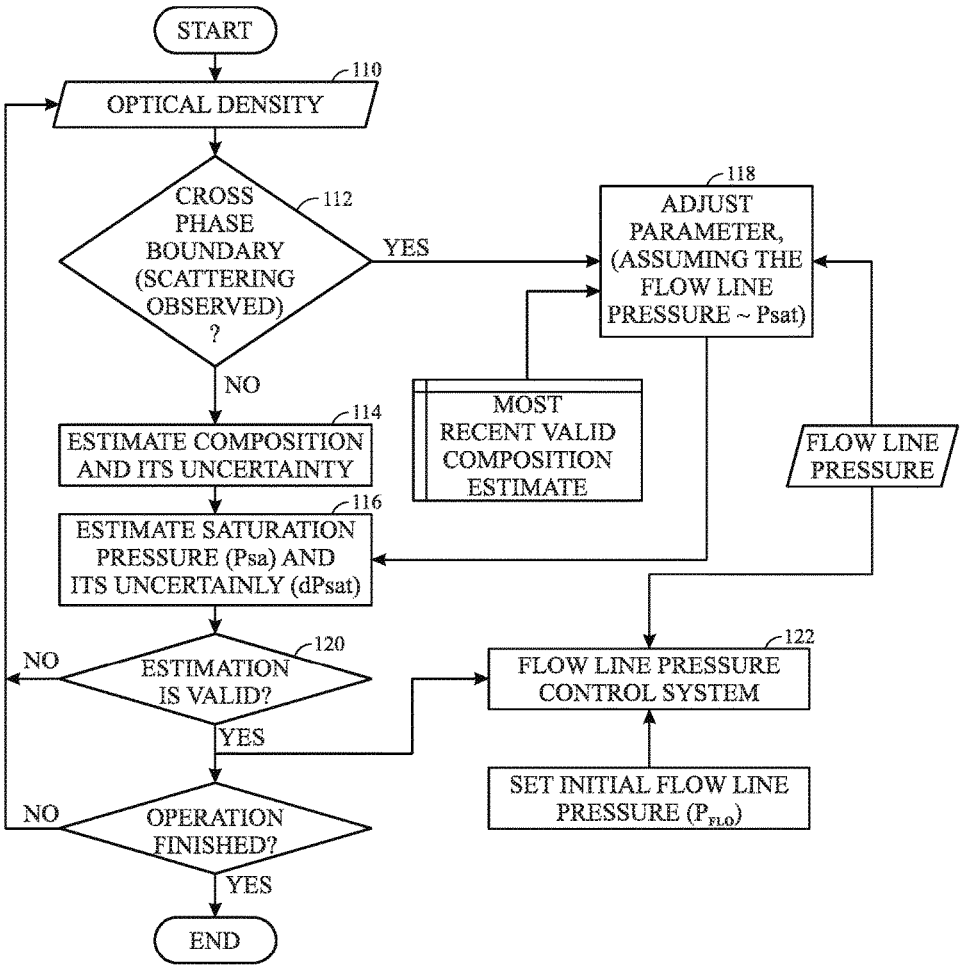
FIG. 10 is a flow diagram of a workflow of a pump control system in accordance with an embodiment of the present techniques.

FIG. 10 is a flow diagram of a workflow of a pump control system in accordance with an embodiment of the present techniques. Optical density data at specified wavelength channels can be acquired almost continuously (block 110). For example, the optical density data may be obtained at approximately 2 Hz, 4 Hz, 6 Hz, and so forth. Once the optical density data is obtained, the pump control system determines whether or not light scattering is observed (block 112). The optical density data should indicate light scattering if the flow line pressure is below the saturation pressure of the fluid present in the flow line. The scattering may be detected using the technique described in U.S. application Ser. No. 13/693782, "Scattering Detection from Downhole Optical Spectra," which is assigned to Schlumberger Technology Corporation and is incorporated by reference herein in its entirety for all purposes. If no indication of the light scattering is observed, the composition of the flow line fluid and its uncertainty are estimated, and the saturation pressure (Psat) and its uncertainty (dPsat) are estimated (block 114).

If the optical density data indicates crossing below the saturation pressure, the estimated composition by the adjustment parameter, α, in eq. (8) (block 116). The adjustment parameter, α, uses the most recent valid estimated composition and assumes the saturation pressure is nearly equal to the flow line pressure (block 118). An adjustment to the is made to the saturation pressure model by including the obtained parameter, α, for the following saturation pressure estimations as long as the value is valid (e.g., until the next parameter adjustment, block 120). If the estimated saturation pressure is valid, the estimated saturation pressure is fed into the pressure control system (e.g., pump control model, block 122) to maintain the flow line pressure above the saturation pressure plus a value of its uncertainty. This process is continued until the sampling operation is complete at the sampling station. One example of the pressure control system is described in U.S. Pat. No. 9,115,567, "Method and Apparatus for Determining Efficiency of a Sampling Tool," which is assigned to Schlumberger Technology Corporation and is incorporated by reference herein in its entirety for all purposes.

Figure 11:
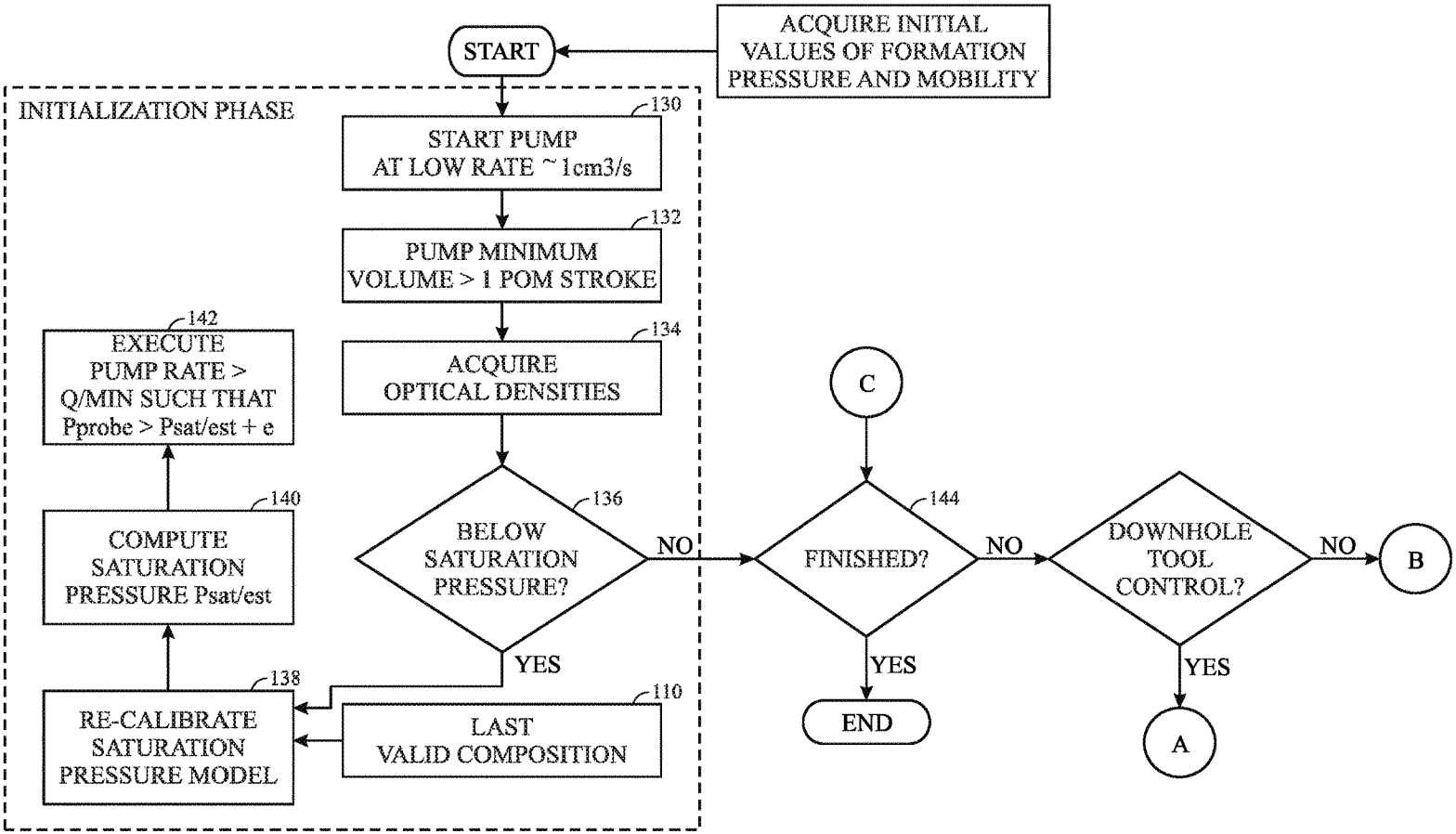
FIG. 11 is a flow diagram of an initialization phase used to obtain information about the flow line fluid.

FIG. 11 is a flow diagram of an initialization phase used to obtain information about the flow line fluid. The initialization phase may use (e.g., acquire) initial values of the formation fluid pressure and the mobility of the flow line to begin. Once the initialization phase begins, a pump may be started at a relatively low (e.g., ~1 $cm^3/s$) pump flow rate (block 130). During the initialization phase, a minimum pump flow volume may be set to maintain a desired pump flow rate. For example, the minimum pump flow volume may be set to greater than 1 pump out module (POM) stroke. After the minimum pump flow volume is set, optical densities of the fluid may be obtained (block 134). Using the techniques described above with respect to FIG. 10, a determination is made whether the fluid remains above the saturation pressure or whether the fluid has gone below the saturation pressure (block 136).

If the optical density data acquired and techniques described herein indicated that the fluid has gone below the saturation pressure, the saturation pressure model is recalibrated (block 138). The saturation pressure model uses the most recent valid estimated composition to recalibrate. Once the saturation pressure model is re-calibrated, the saturation pressure model again computes the estimated saturation pressure of the flow line fluid and the saturation pressure of the flow line fluid (block 140). Then, the saturation pressure model commands the pump flow rate to pump fluid at a rate such that the pressure of the flow line fluid in the probe (e.g., downhole tool) remains greater than the estimated saturation pressure plus the uncertainty (block 142). If the fluid has stayed above the saturation pressure, the initialization phase is complete (block 144). The initialization phase may be followed by downhole tool control and/or uphole tool control as described below with respect to FIGS. 12 and 13.

Figure 12:
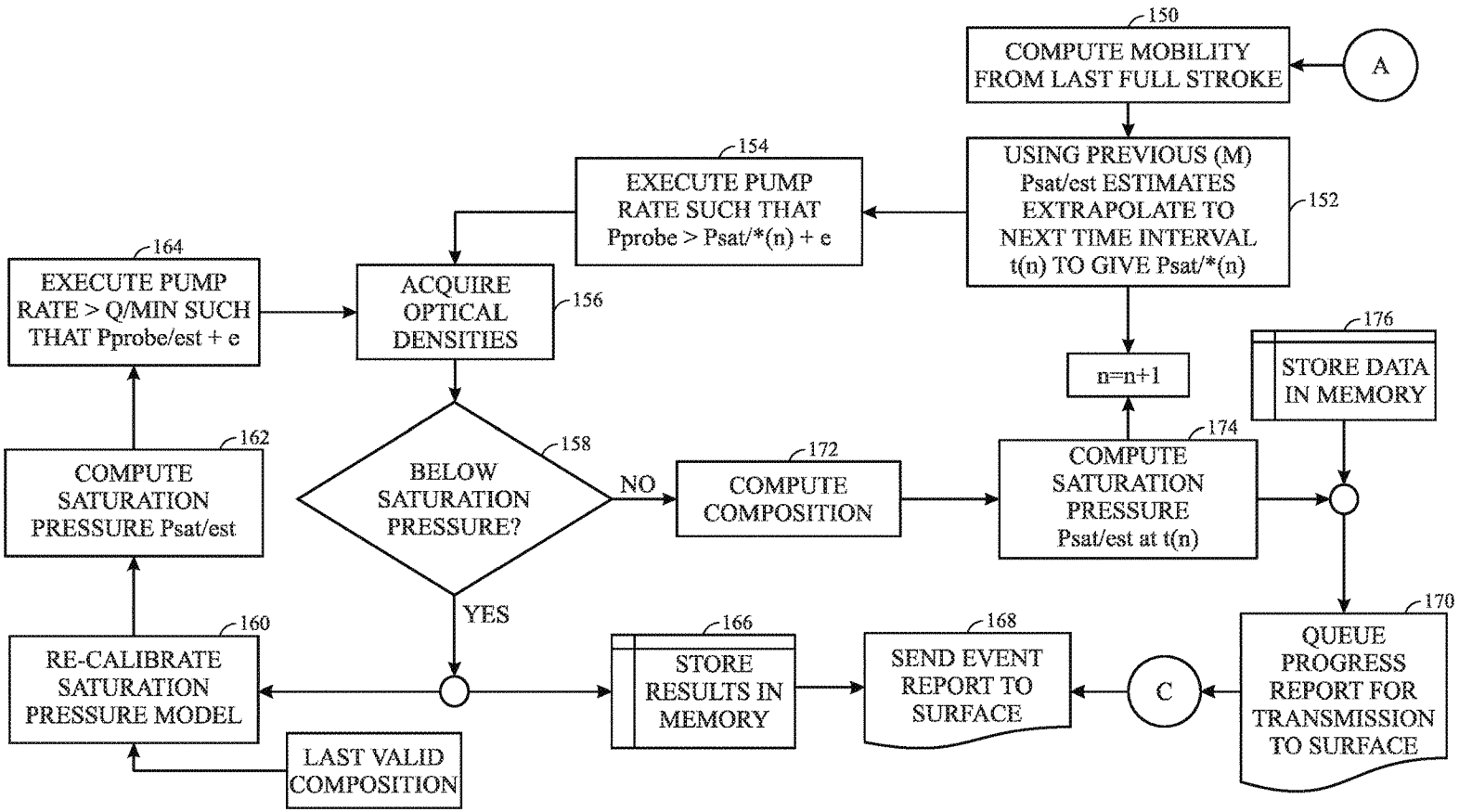
FIG. 12 is a flow diagram of a method for downhole tool control in accordance with an embodiment of the present techniques.

FIG. 12 is a flow diagram of a method for downhole tool control in accordance with an embodiment of the present techniques. The downhole tool control may generally be started upon completion of the initialization phase, or when initialized by an operator or controller. The method of downhole tool control described herein computes mobility from the last full pump stroke (block 150). Computing mobility of the flow line fluid may provide data to enable the controller or operator to assess the resistance of mobility of the flow line fluid and other factors affecting the fluid sampling. The method of downhole tool control includes using a previous estimate of the saturation pressure and its uncertainty to extrapolate to the next time interval (e.g., 15 seconds, 60 seconds) to calculate a future saturation pressure and its uncertainty (block 152). The method of downhole tool control includes controlling the pump flow rate such that the pressure of the fluid in the probe (e.g., downhole tool) remains greater than the estimated saturation pressure at the next time interval, plus the uncertainty (block 154). The method of downhole tool control includes acquiring optical density data (block 156) to determine whether the flow line fluid has stayed above the saturation pressure or whether the flow line fluid has gone below the saturation pressure (block 158).

If the flow line fluid has gone below the saturation pressure, the method of downhole tool control includes recalibrating the saturation pressure model (e.g., the first saturation pressure model) (block 160). The saturation pressure model uses the most recent valid estimated composition to recalibrate. Once the saturation pressure model is recalibrated, the saturation pressure model again computes the estimated saturation pressure of the flow line fluid and the saturation pressure of the flow line fluid (block 162). Then, the saturation pressure model commands the pump flow rate to pump flow line fluid at a rate such that the pressure of the flow line fluid in probe (e.g., downhole tool) remains greater than the estimated saturation pressure plus the uncertainty (block 164). The method of downhole tool control includes storing the results of the data (block 166). For example, the data stored may include data indicating the estimated saturation pressure of the flow line fluid dropped below the saturation pressure, the saturation pressure of the flow line at certain time intervals, other sample data, or any combination thereof. The method of downhole tool control includes sending the event message (e.g., indication of the saturation pressure of the flow line fluid dropping below the estimated saturation pressure plus its uncertainty of the flow line fluid) to the surface for reporting (block 168). The method of downhole tool control includes generating a progress report for transmission of the event message to the surface (block 170). The method of downhole tool control includes storing the results to generate the progress report (block 176). An operator or controller may take control of the downhole tool from the surface at any time during the method described herein. For example, an operator may wish to manually control the downhole tool from the surface upon receiving notice of an event message.

If the pressure of the flow line fluid has remained above the saturation pressure, the method of downhole tool control includes continuing to compute the composition of the flow line fluid (block 172). The method of downhole tool control includes continuing to compute the saturation pressure and the estimated saturation pressure plus its uncertainty at the next time interval (block 174). The method of downhole tool control includes storing data such as the saturation pressure and estimated saturation pressure and its uncertainty (block 176).

Figure 13:
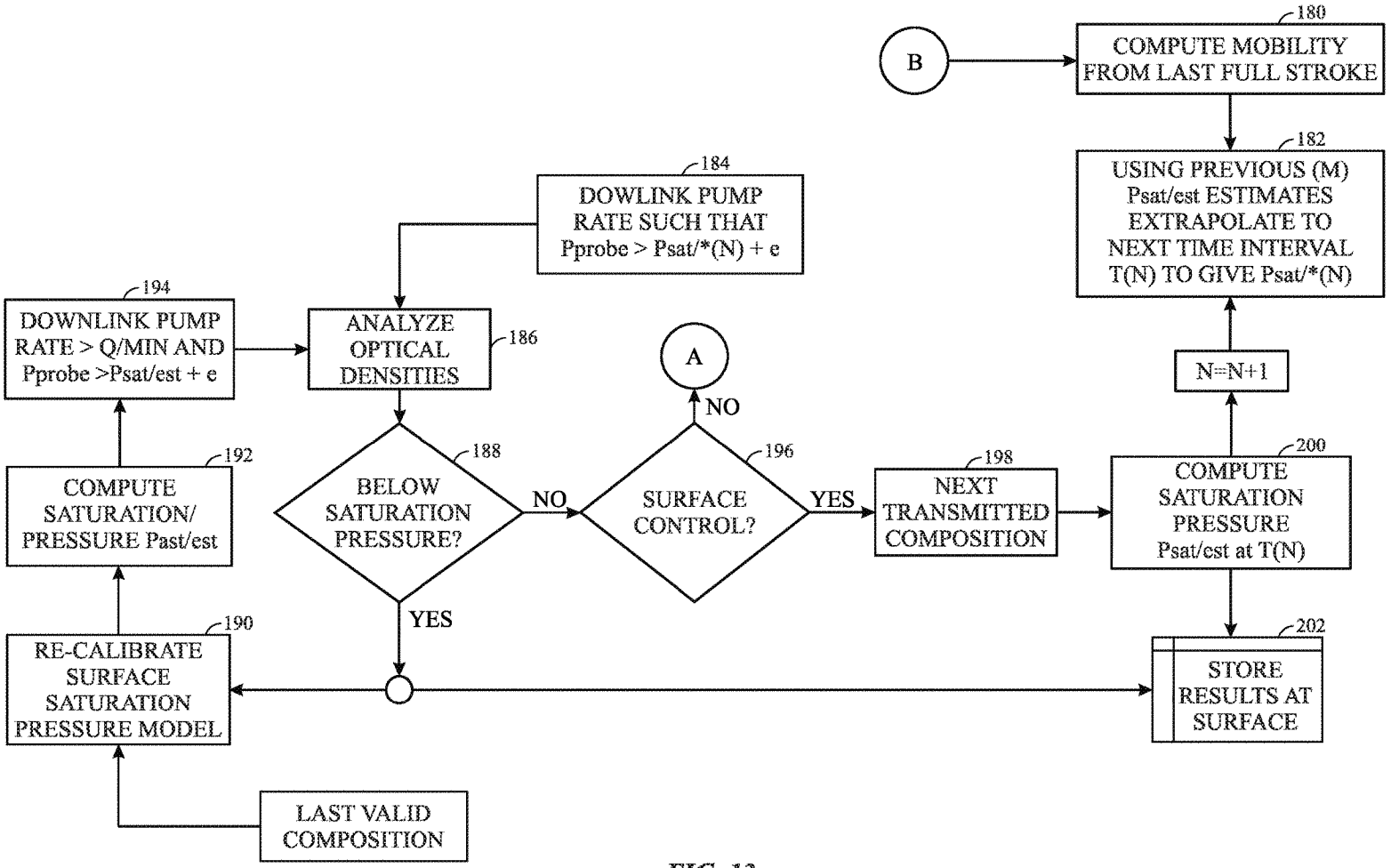
FIG. 13 is a flow diagram of a method for uphole tool control in accordance with an embodiment of the present techniques.

FIG. 13 is a flow diagram of a method for uphole tool control in accordance with an embodiment of the present techniques. The uphole tool control may generally be started upon completion of the initialization phase, or when initialized by an operator or controller. The method of uphole tool control described herein computes mobility from the last full pump stroke (block 180). Computing mobility of the flow line fluid may provide data to enable the controller or operator to assess the resistance of mobility of the flow line fluid and other factors affecting the fluid sampling. The method of uphole tool control includes using a previous estimate of the saturation pressure and its uncertainty to extrapolate to the next time interval (e.g., 4.5 minutes) to calculate future saturation pressure and its uncertainty at the next time interval (block 182). The method of uphole tool control includes controlling the pump flow rate such that the pressure of the flow line fluid in the probe (e.g., downhole tool) remains greater than the estimated saturation pressure plus the uncertainty at the next time interval (block 184). The method of uphole tool control includes analyzing optical density data (block 186) to determine whether the pressure of the flow line fluid has remained above the saturation pressure or whether the pressure of the flow line fluid has gone below the saturation pressure (block 188).

If the pressure of the flow line fluid has gone below the saturation pressure, the method of uphole tool control includes recalibrating the saturation pressure model (e.g., the second saturation pressure model) (block 190). The saturation pressure model uses the most recent valid estimated composition to recalibrate. Once the saturation pressure model is re-calibrated, the saturation pressure model again computes the estimated saturation pressure of the flow line fluid and the saturation pressure of the flow line fluid (block 192). Then, the saturation pressure model commands the pump flow rate to pump fluid at a rate such that the pressure of the flow line fluid in the probe (e.g., downhole tool) remains greater than the estimated saturation pressure plus the uncertainty (block 194).

If the flow line fluid has remained above the saturation pressure, the method of uphole tool control includes determining if the operator or controller will attempt to control the pressure of the flow line from the surface (block 196). If the operator or controller determines no surface control will be utilized, the flow line may be controlled using the downhole control methods described herein with respect to FIG. 12. If the operator or controller determines surface control will be utilized, the method of uphole tool control includes analyzing a next transmitted composition (block 198). The method of uphole tool control includes computing the saturation pressure and the estimated saturation pressure at the next time interval (block 200). The method of uphole tool control includes storing data from the computed saturation pressure and estimated saturation pressure (block 202). The stored data may be used to re-calibrate the surface saturation pressure model in the event that the saturation pressure of the flow line fluid drops below the estimated saturation pressure plus its uncertainty.

Figure 14:
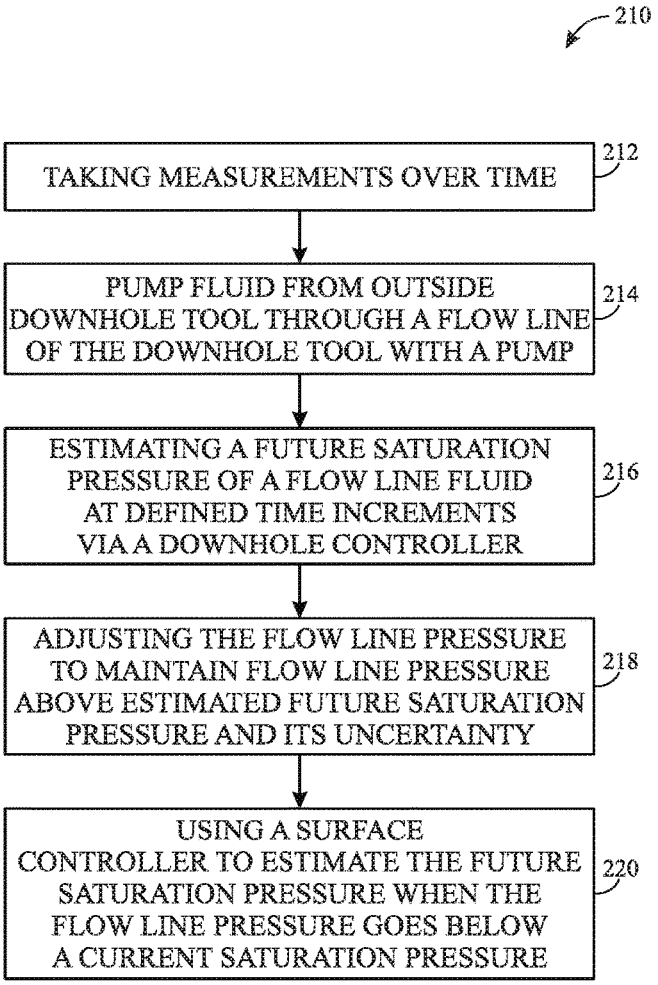
FIG. 14 is a flow diagram of a method for transitioning between downhole tool control and uphole tool control in accordance with an embodiment of the present techniques.

FIG. 14 is a flow diagram of a method for transitioning between downhole tool control and uphole tool control in accordance with an embodiment of the present techniques. The method 210 includes pumping a fluid from outside the downhole tool through a flow line of the downhole tool with a pump (block 212). The method 210 includes taking a first plurality of measurements over time using one or more sensors (block 214). The method 210 includes estimating a future saturation pressure of the fluid within the flow line at defined time increments with a downhole tool controller based at least in part on the first plurality of measurements and a first saturation pressure model (block 216). The method 210 includes adjusting the flow line pressure to maintain the pressure of the flow line above the estimated future saturation pressure and its uncertainty (block 218). The method 210 includes using a surface controller to estimate the future saturation pressure when the flow line pressure goes below a current saturation pressure of the flow line, based at least in part on the first plurality of measurements and a second saturation pressure model (block 220).

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The invention claimed is:

1. A downhole fluid testing system comprising:

a downhole acquisition tool housing configured to be moved into a wellbore in a geological formation, wherein the wellbore or the geological formation, or both, contain fluid that comprises a native reservoir fluid of the geological formation and a contaminant;

a pump configured to pump fluid through a flow line through the downhole acquisition tool;

an optical spectrometer comprising at least one sensor disposed in the downhole acquisition tool housing, wherein the optical spectrometer is configured to receive a first plurality of measurements output by the at least one sensor and to analyze portions of the fluid to obtain a fluid property of the fluid, wherein the fluid property includes an optical density; and a controller comprising memory circuitry and processing circuitry, wherein the controller is communicatively coupled downhole to the housing, and wherein the controller is configured to:

receive the first plurality of measurements over time from the at least one sensor;

estimate a future saturation pressure of the fluid and a value of an associated uncertainty within the flow line at specific time increments via the processing circuitry based at least in part on the first plurality of measurements and a saturation pressure model; and control a flow rate of the pump that causes the flow line pressure to remain above the estimated future saturation pressure plus the value of the associated uncertainty.

2. The downhole fluid testing system of claim 1, wherein the controller recalibrates the saturation pressure model when the flow line pressure drops below the estimated future saturation pressure plus the value of the associated uncertainty.

3. The downhole fluid testing system of claim 1, wherein the controller is configured to send an event message to a surface controller when the flow line pressure drops below the estimated future saturation pressure plus the value of the associated uncertainty.

4. The downhole fluid testing system of claim 3, wherein the controller is configured to generate a progress report to be transmitted to the surface controller when the flow line pressure drops below the estimated future saturation pressure plus the value of the associated uncertainty.

5. The downhole fluid testing system of claim 1, wherein the controller is configured to store data of the downhole fluid testing system when the flow line pressure drops below the estimated future saturation pressure plus the value of the associated uncertainty.

6. The downhole fluid testing system of claim 1, wherein the controller is configured to compute a composition of the flow line fluid at specified intervals when the flow line pressure remains above the estimated future saturation pressure plus the value of the associated uncertainty.

7. The downhole fluid testing system of claim 1, wherein the controller is configured to compute the estimated saturation pressure at specified time intervals via extrapolation when the flow line pressure remains above the estimated future saturation pressure plus the value of the associated uncertainty.

8. The downhole fluid testing system of claim 7, wherein the controller is configured to store the computed estimated saturation pressure of the downhole fluid testing system when the flow line pressure remains above the estimated future saturation pressure plus the value of the associated uncertainty.

9. A downhole fluid testing system, comprising:

a downhole acquisition tool housing configured to be moved into a wellbore in a geological formation, wherein the wellbore or the geological formation, or both, contain fluid that comprises a native reservoir fluid of the geological formation and a contaminant;

a pump configured to pump fluid through the downhole acquisition tool;

an optical spectrometer comprising at least one sensor disposed in the downhole acquisition tool housing, wherein the at least one sensor is configured to receive a first plurality of measurements and to analyze portions of the fluid and obtain a fluid property of the fluid from an optical spectrometer, wherein the fluid property includes an optical density; and a controller comprising memory circuitry and processing circuitry, wherein the controller is communicatively coupled to a surface level of the housing, and wherein the controller is configured to:

receive the first plurality of measurements over time from the at least one sensor;

estimate a future saturation pressure of the fluid and a value of an associated uncertainty within the flow line at specific time increments via the processing circuitry based at least in part on the first plurality of measurements and a saturation pressure model; and control a flow rate of the pump that causes the flow line pressure to remain above the estimated future saturation pressure plus the value of the associated uncertainty.

10. The downhole fluid testing system of claim 9, wherein the controller recalibrates the saturation pressure model when the flow line pressure drops below the estimated future saturation pressure plus the value of the associated uncertainty.

11. The downhole fluid testing system of claim 10, wherein the controller recalibrates the saturation pressure model using a last valid composition.

12. The downhole fluid testing system of claim 9, wherein controller is configured to compute the composition of the flow line fluid at specified intervals when the flow line pressure remains above the estimated future saturation pressure plus the value of the associated uncertainty.

13. The downhole fluid testing system of claim 9, wherein the controller is configured to compute the estimated saturation pressure at specified time intervals via extrapolation when the flow line pressure remains above the estimated future saturation pressure plus the value of the associated uncertainty.

14. The downhole fluid testing system of claim 9, wherein the controller is configured to store data of the downhole fluid testing system when the flow line pressure drops below the estimated future saturation pressure plus the value of the associated uncertainty.

15. The downhole fluid testing system of claim 9, wherein the controller is configured to store the computed estimated saturation pressure of the downhole fluid testing system when the flow line pressure remains above the estimated future saturation pressure plus the value of the associated uncertainty.

16. A method comprising:

pumping fluid from outside of a downhole tool through a flow line of the downhole tool with a pump;

taking a first plurality of measurements over time using at least one sensor;

estimating a future saturation pressure of the fluid within the flow line and a value of its uncertainty at defined time increments via a downhole controller based at least in part on the first plurality of measurements and a first saturation pressure model;

adjusting the flow line pressure to maintain the pressure of the flow line above the estimated future saturation pressure; and using a surface controller at the surface to estimate the future saturation pressure when the flow line pressure goes below a saturation pressure of the flow line, based at least upon the first plurality of measurements and a second saturation pressure model.

17. The method of claim 16, wherein the future saturation pressure is estimated using the downhole controller at least in part by:

receiving the first plurality of measurements over time from the at least one sensor; and estimating the future saturation pressure of the fluid within the flow line at specific time increments via a processor communicatively coupled to the downhole controller, based at least in part on the first plurality of measurements and the first saturation pressure model; and adjusting the flow line pressure using the downhole controller to control a flow rate of the pump.

18. The method of claim 17, wherein controlling the flow rate of the pump comprises controlling the flow rate of the pump to cause the flow line pressure to remain above the estimated future saturation pressure plus a value of the associated uncertainty.

19. The method of claim 16, comprising sending an event message to the surface controller via the downhole controller when the flow line pressure drops below the estimated future saturation pressure plus the value of the associated uncertainty.

20. The method of claim 16, wherein the future saturation pressure is estimated using the downhole controller at least in part by:

executing the first saturation pressure model, wherein the first saturation pressure model provides greater accuracy than the second saturation pressure model based in part on resources consumed by the first saturation pressure model.

* * * * *